US007990043B2

(12) United States Patent
Tang et al.

(10) Patent No.: US 7,990,043 B2
(45) Date of Patent: Aug. 2, 2011

(54) FIELD EMISSION CATHODE STRUCTURE AND FIELD EMISSION DISPLAY USING THE SAME

(75) Inventors: Jie Tang, Beijing (CN); Hai-Yan Hao, Beijing (CN); Qi Cai, Beijing (CN); Xing Zhang, Beijing (CN); Shuai Liu, Beijing (CN); Bing-Chu Du, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/695,642

(22) Filed: Jan. 28, 2010

(65) Prior Publication Data

US 2011/0074274 A1 Mar. 31, 2011

(30) Foreign Application Priority Data

Sep. 30, 2009 (CN) ..... 2009 1 0190568

(51) Int. Cl.
*H01J 17/49* (2006.01)

(52) U.S. Cl. ..... 313/495; 313/497

(58) Field of Classification Search ..... 313/495–497
See application file for complete search history.

(56) References Cited

U.S. PATENT DOCUMENTS

2002/0167266 A1* 11/2002 Hirasawa et al. ..... 313/496
2004/0135490 A1* 7/2004 Lee et al. ..... 313/495
2005/0264165 A1* 12/2005 Ryu ..... 313/495

* cited by examiner

*Primary Examiner* — Anne Hines
(74) *Attorney, Agent, or Firm* — D. Austin Bonderer

(57) ABSTRACT

A field emission cathode structure includes a dielectric layer, a field emission unit, a grid electrode, and a conductive layer. The dielectric layer is positioned on the insulating substrate and defines a cavity. A field emission unit is attached on the cathode electrode and received in the cavity of the dielectric layer. The field emission unit is electrically attached to the cathode electrode. The grid electrode is located on the dielectric layer, and electrons emitted from the field emission unit emit through the grid electrode. The conductive layer is electrically attached to the grid electrode and insulated from the field emission unit. A field emission display device using the above-mentioned field emission cathode structure is also provided.

20 Claims, 12 Drawing Sheets

FIELD EMISSION CATHODE STRUCTURE AND FIELD EMISSION DISPLAY USING THE SAME

RELATED APPLICATIONS

This application claims all benefits accruing under 35 U.S.C. §119 from China Patent Application No. 200910190568.3, filed on Sep. 30, 2009 in the China Intellectual Property Office.

BACKGROUND

1. Technical Field

The present disclosure relates to a field emission cathode structure and a field emission display using the same.

2. Discussion of Related Art

Field emission displays (FEDs) are a novel, rapidly developing flat panel display technology. Compared to conventional displays, such as cathode-ray tube (CRT) and liquid crystal display (LCD), FEDs are superior in providing a wider viewing angle, lower energy consumption, smaller size, and higher quality.

Generally, FEDs can be roughly classified into diode and triode structures. Diode structures have a cathode electrode and an anode electrode, and are suitable for displaying characters, not suitable for displaying images. The diode structures require high voltage, produce relatively non-uniform electron emissions, and require relatively costly driving circuits. Triode structures were developed from diode structures by adding a gate electrode for controlling electron emission. Triode structures can emit electrons at relatively lower voltages.

Referring to FIGS. 11 and 12, a triode field emission cathode structure 10 is disclosed. The field emission cathode structure 10 includes an insulating substrate 12, a number of cathodes 14, a plurality of field emission units 11, a plurality of strip dielectric layers 16, and a plurality of grid electrodes 18. Specifically, the cathodes 14 fixed on the insulating substrate 12 are spaced from and parallel to each other. The field emission units 11 are positioned on the cathodes 14 and electrically connected to the cathodes 14. Each field emission unit 11 includes a plurality of field emitters. The dielectric layers 16 are mounted directly on the insulating substrate 12 and located at two flanks of the cathodes 14 to expose the field emission units 11. The grid electrodes 18 directly mounted on top surfaces of the dielectric layers 16. An axis of the grid electrode 18 is perpendicular to that of the cathodes 14.

When the field emission cathode structure 10 is operated, electrons are emitted from the field emitters. Part of the electrons hit the dielectric layers 16, and secondary electrons are emitted. After the secondary electrons are emitted, positive charges are accumulated on the dielectric layers 16; thus, the positive charges can change the potential around the dielectric layers 16. The change of the potential around the dielectric layers 16 results in increasing difficulty of controlling electron emission directions. Such that, images of a field emission display using the field emission structure 10 have low resolution.

What is needed, therefore, is a field emission cathode structure and a field emission display using the same with superior display resolution.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
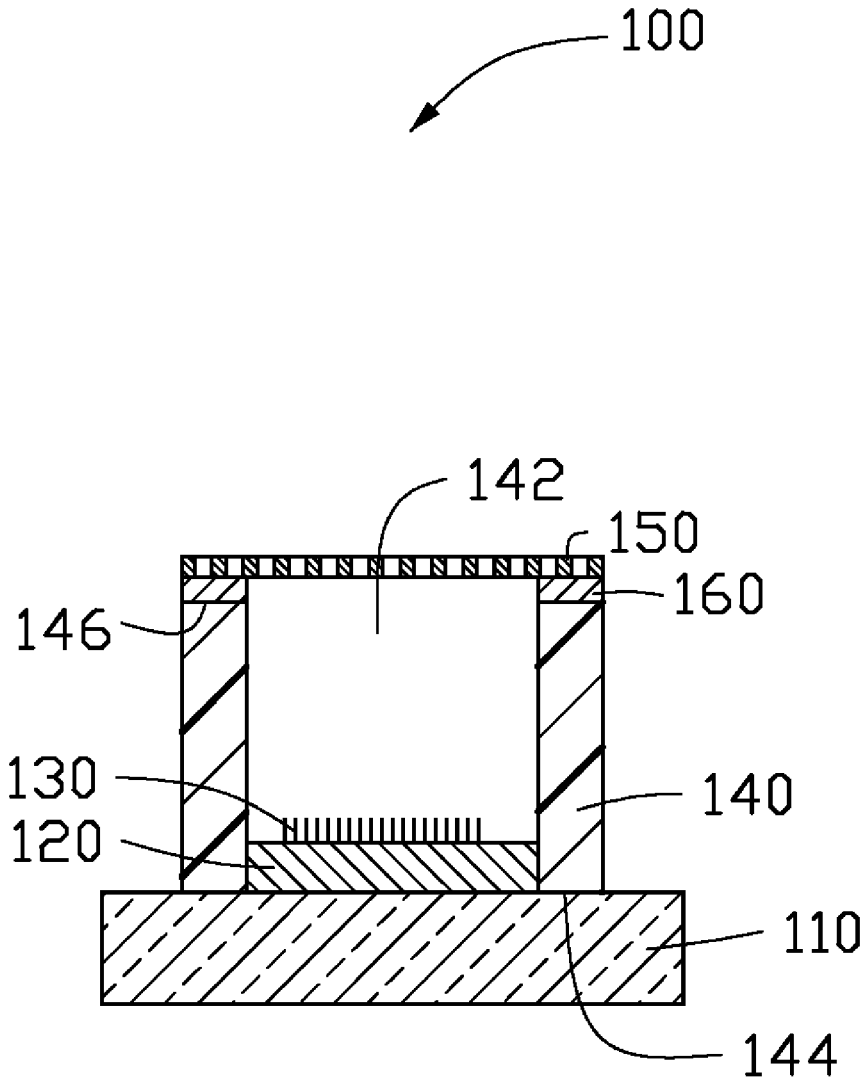
FIG. 1 is a cross-sectional view of one embodiment of a filed emission cathode structure.

Referring to FIG. 1, a field emission cathode structure 100 of one embodiment is provided. The field emission cathode structure 100 includes an insulating substrate 110, a cathode electrode 120, a field emission unit 130, a dielectric layer 140, a grid electrode 150, and a conductive layer 160. The cathode electrode 120 is located on the insulating substrate 110. The field emission unit 130 is electrically connected to and positioned on the cathode electrode 120. The dielectric layer 140 is positioned on the insulating substrate 110. The dielectric layer 140 can be contacted with the cathode electrode 120, as can be seen in FIG. 1. The conductive layer 160 can be positioned on the dielectric layer 140. The grid electrode 150 can be positioned on and electrically connected to the conductive layer 160. The grid electrode 150 is electrically insulated from the field emission unit 130 by the dielectric layer 140.

The insulating substrate 110 can be made of glass, silicon dioxide, ceramic, or other insulating materials. In one embodiment, the insulating substrate 110 is made of glass.

The cathode electrode 120 can be made of copper, aluminum, gold, silver, indium tin oxide (ITO), or a combination thereof. In one embodiment, the cathode electrode 120 is made of silver.

The field emission unit 130 includes a plurality of field emitters mounted thereon. The field emitters can be metal having sharp tips, silicon having sharp tips, carbon nanotubes, or other materials. In one embodiment, the field emitters are carbon nanotubes.

The dielectric layer 140 has a bottom surface 144, and a top surface 146. The bottom surface 144 is attached to the insulating substrate 110. The dielectric layer 140 defines a cavity 142. The field emission unit 130 is received in the cavity 142. In one embodiment, both the cathode electrode 120 and the field emission unit 130 are received in the cavity 142. The dielectric layer 140 is made of insulating material, such as glass, silicon dioxide, or ceramic. A thickness of the dielectric layer 140 can be greater than 15 micrometers (μm). In one embodiment, the dielectric layer 140 is made of ceramic, and the thickness thereof is 20 μm.

The conductive layer 160 is located on the top surface 146 of the dielectric layer 140. Specifically, the conductive layer 160 can be directly located on the top surface 146 of the dielectric layer 140, and without any other elements located therebetween, as can be seen in FIG. 1. The conductive layer 160 also can be indirectly mounted on the top surface 146 of the dielectric layer 140. The conductive layer 160 is configured for releasing the possible charges formed in the dielectric layer 140, during operation thereof. The conductive layer 160 can be formed by coating or printing conductive slurry on the top surface 146 of the dielectric layer 140. A material of the conductive layer 160 can be metal, alloy, ITO, antimony tin oxide, silver conductive adhesive, conducting polymers, carbon nanotubes, or other conductive materials. The metal includes aluminum, silver, copper, tungsten, molybdenum, or gold. The alloy can comprise of aluminum, copper, silver, tungsten, molybdenum, gold or combinations thereof. In one embodiment, the conductive layer 160 is directly located on the top surface 146 of the dielectric layer 140, and the material of the conductive layer 16 is silver.

The grid electrode 150 can be directly positioned on the conductive layer 160. The grid electrode 150 is a metal net with a plurality of holes distributed therein. Electrons emitted from the field emission unit 130 can pass through the holes to be emitted. The holes have a size, and that size can vary such it can prevent the passage of particles in range from about 3 μm to about 1000 μm. A distance between the grid electrode 150 and the cathode electrode 120 can be equal to or greater than 10 μm. In one embodiment, the grid electrode 150 is a stainless steel net, and the distance between the grid electrode 150 and the cathode electrode 120 is about 15 μm.

In operation, different voltages are applied to the cathode electrode 120 and the grid electrode 150. Generally, the cathode electrode 120 is grounded. The voltage of the grid electrode 150 can range from about ten to several hundreds volts (V). The electrons emitted from the field emission unit 130 move towards the grid electrode 150, under the influence of the applied electric field induced by the grid electrode 150.

More specifically, most of the electrons emitted from the field emission unit 130 pass through the holes of the grid electrode 150, to hit predetermined positions. Part of the electrons emitted from the field emission unit 130, after passing through the holes of the grid electrode 150, come back to the grid electrode 150 or the conductive layer 160. Since the conductive layer 160 is electrically connected to the grid electrode 150, part of the electrons coming back to the grid electrode 150 or the conductive layer 160 can be released. Thus, it can decrease the number of electrons that hit the dielectric layer 140, or even eliminate electrons hitting the dielectric layer 140. Thus, the dielectric layer 140 will emit fewer secondary electrons or, even, none at all.

A small portion of electrons emitted from the field emission unit 130 can directly hit the dielectric layer 140 and cause the dielectric layer 140 to emit secondary electrons. Some positive charges will be formed in the dielectric layer 140. The conductive layer 160 is electrically connected to the grid electrode, the positive charges can be released through the conductive layer 160, and reach to the grid electrode 150. Thus, the potential around the dielectric layer 140 is not substantially changed, when using the conductive layer 160, even if some electrons hit the dielectric layer 140.

Since it is difficult for electrons emitted from the field emission unit 130 of the field emission cathode structure 100 to hit the dielectric layer 140 and other elements, the field emission cathode structure 100 can control the electrons and focus them on the predetermined positions.

Figure 2:
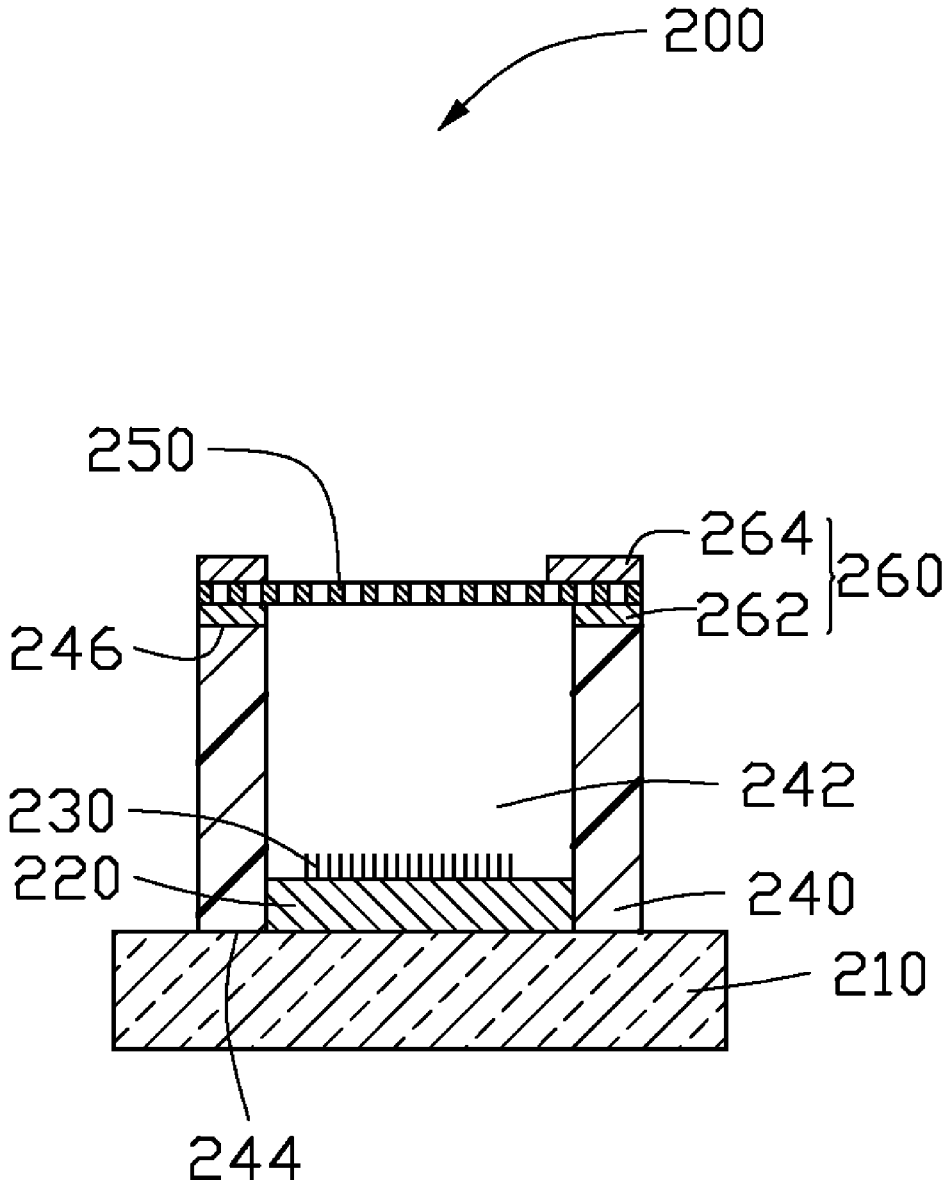
FIG. 2 is a cross-sectional view of another embodiment of a filed emission cathode structure.

Referring to FIG. 2, a field emission cathode structure 200 of another embodiment is provided. The field emission cathode structure 200 includes an insulating substrate 210, a cathode electrode 220, a field emission unit 230, a dielectric layer 240, a grid electrode 250, and a conductive layer 260. The dielectric layer 240 has a bottom surface 244, a top surface 246, and defines a cavity 242.

The field emission cathode structure 200 is similar to the field emission cathode structure 100. The difference between them is that the conductive layer 260 includes a first conductive layer 262 and a second conductive layer 264. The first conductive layer 262 is directly located on the top surface 246 of the dielectric layer 240, and the second conductive layer 264 is directly positioned on the grid electrode 250. The grid electrode 250 is located between the first and second conductive layers 262, 264. The first and the second conductive layers 262, 264 are configured to be located at two flanks of the field emission unit 230 to prevent them from blocking the electrons emitted from the field emission unit 230. The function of the first and second conductive layers 262, 264 is similar to the conductive layer 160 in the field emission cathode structure 100. However, the second conductive layer 264 can fix the grid electrode 250 on the first conductive layer 262, to reduce or prevent the grid electrode 250 from deforming during an operation of the grid electrode 250.

Figure 3:
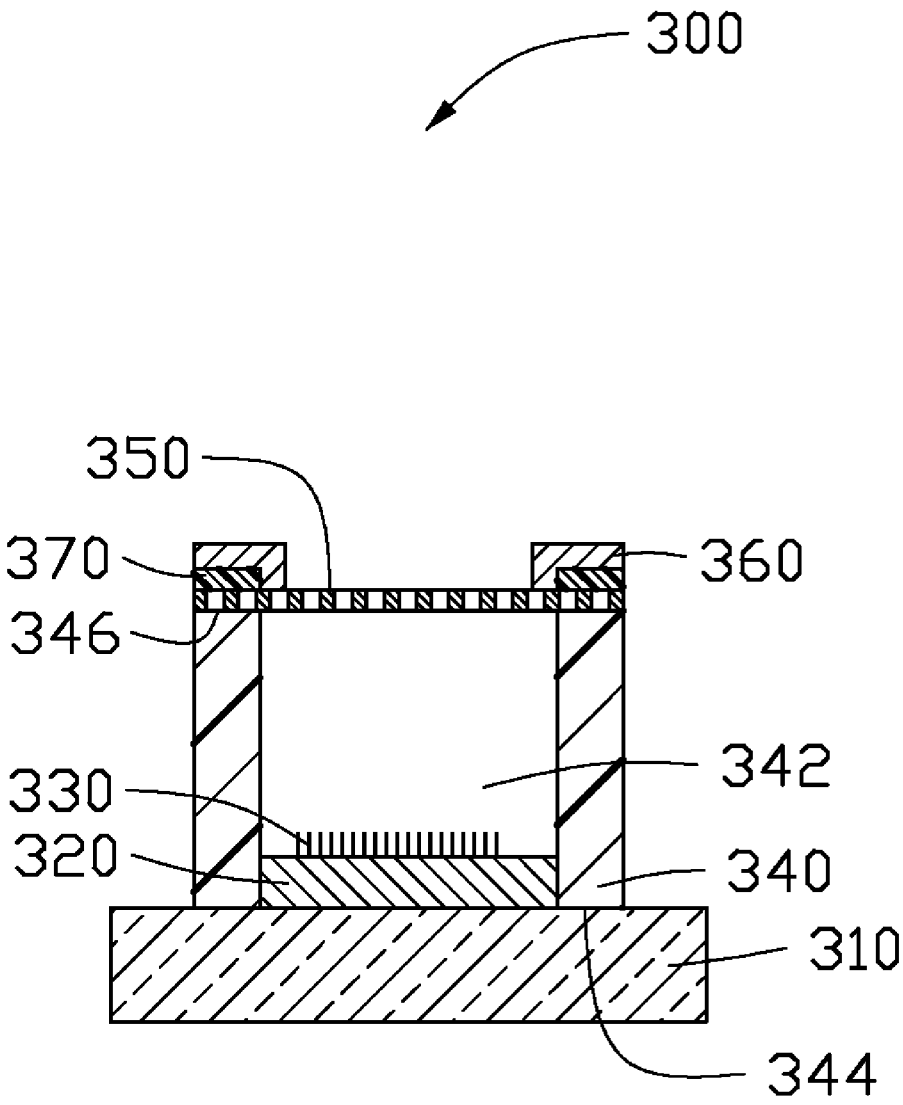
FIG. 3 is a cross-sectional view of one embodiment of a filed emission cathode structure.

Referring to FIG. 3, a field emission cathode structure 300 of another embodiment is provided. The field emission cathode structure 300 includes an insulating substrate 310, a cathode electrode 320, a field emission unit 330, a dielectric layer 340, a grid electrode 350, a conductive layer 360, and a fixed layer 370. The dielectric layer 340 has a bottom surface 344 and a top surface 346 opposite to the bottom surface 344, and defines a cavity 342.

The field emission cathode structure 300 is similar to the field emission cathode structure 100. However, the grid electrode 350 is directly located on the top surface 346 of the dielectric layer 340. The conductive layer 360 is indirectly located on the top surface 346 of the dielectric layer 340. The field emission cathode structure 300 further includes the fixed layer 370. The fixed layer 370 is directly located on top of the grid electrode 350, and the grid electrode 350 is positioned between the fixed layer 370 and the top surface 346 of the dielectric layer 340. The conductive layer 360 is directly located on the fixed layer 370, and covers inner surface of the fixed layer 370. The conductive layer 360 is configured for releasing the possible charges formed in the fixed layer 370 during an operation of the grid electrode 350. The fixed layer 370 and conductive layer 360 are configured to be located at two flanks of the field emission unit 330 to prevent them from blocking the electrons emitted from the field emission unit 330. The fixed layer 370 and conductive layer 360 should not completely cover the cavity 342.

A material of the fixed layer 370 can be the same as that of the dielectric layer 340. The fixed layer 370 is configured for fastening the grid electrode 350 in order to prevent the grid electrode 350 from deforming during operation thereof. Specially, when the grid electrode 350 is adjacent to the cathode electrode 320, the grid electrode 350 and cathode electrode 320 would not be short circuit by the deformation of the grid electrode 350. When a small part of electrons emitted from the field emission unit 330 hit the fixed layer 370, the fixed layer 370 can emit secondary electrons, the fixed layer 370 displays positive charges. The conductive layer 360 is electrically connected to the grid electrode 350 and the fixed layer 370. Thus, the positive charges in the fixed layer 370 can be released via the conductive layer 360, and reach to the grid electrode 350. The potential around the fixed layer 370 substantially is not substantially changed. It is conducive to electrons emitted from the field emission unit 330 focusing on the predetermined positions.

It is understood that the fixed layer 370 can be optional. When the field emission cathode structure 300 lacks the fixed layer 370, the conductive layer 360 is directly located on the grid electrode 350, and the grid electrode 350 is positioned between the conductive layer 360 and the top surface 346 of the dielectric layer 340. The conductive layer 360 also can fix the grid electrode 350 to reduce or prevent the grid electrode 350 from deforming during an operation of the grid electrode 350.

Figure 4:
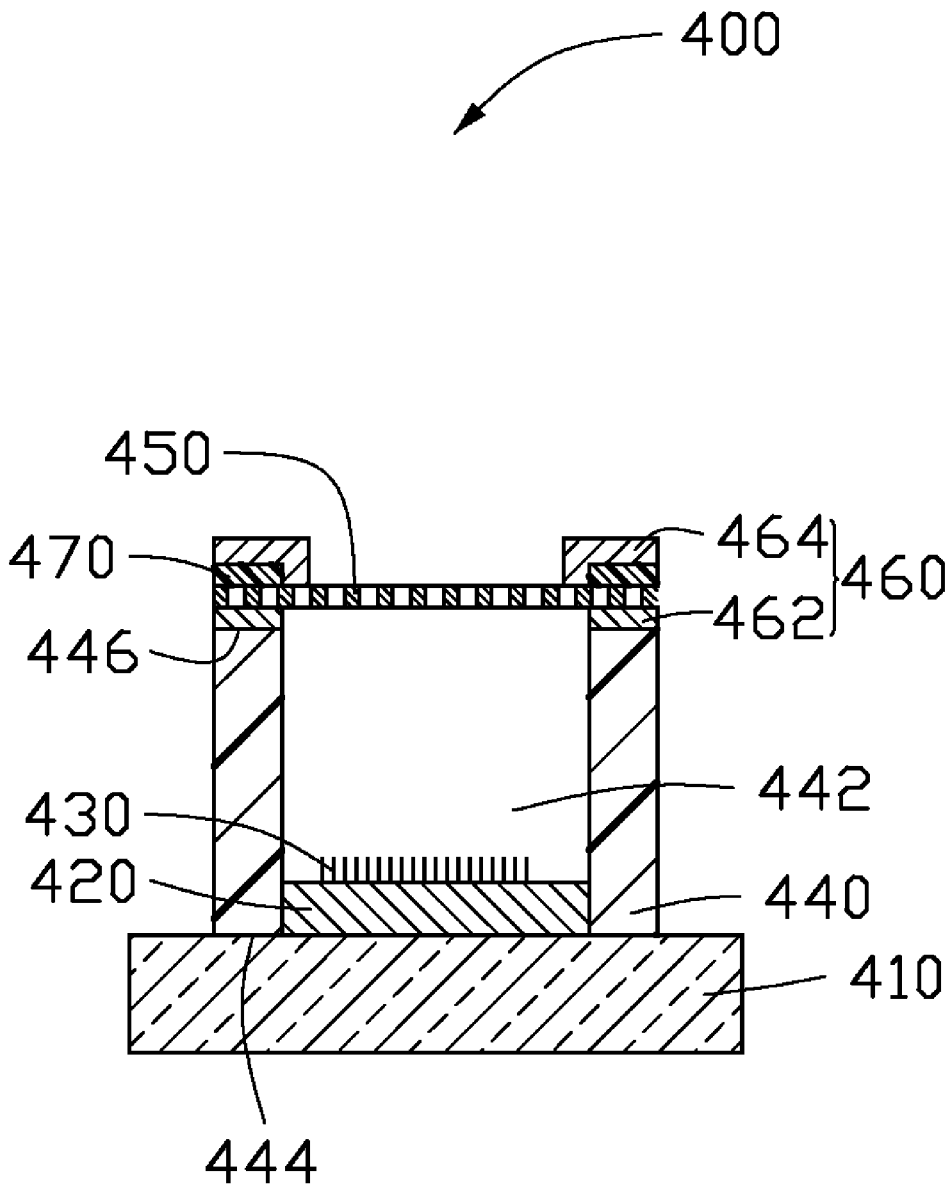
FIG. 4 is a cross-sectional view of one embodiment of a filed emission cathode structure.

Referring to FIG. 4, a field emission cathode structure 400 of one embodiment is shown. The field emission cathode structure 400 includes an insulating substrate 410, a cathode electrode 420, a field emission unit 430, a dielectric layer 440, a grid electrode 450, a conductive layer 460, and a fixed layer 470. The dielectric layer 440 has a bottom surface 444, a top surface 446, and defines a cavity 442.

The field emission cathode structure 400 is similar to the field emission cathode structure 300. However, in the field emission cathode structure 400, the conductive layer 460 includes a first conductive layer 462 and a second layer 464. The first conductive layer 462 is directly located on the top surface 446 of the dielectric layer 440. The second layer 464 is located on the fixed layer 470, and covers inner surface of the fixed layer 470. The material and function of the conductive layer 462 is the same as that of the conductive layer 262 in the field emission cathode structure 200. Thus the first conductive layer 462 is configured for releasing the possible charges formed in the dielectric layer 440. The material and function of the conductive layer 464 is the same as that of the conductive layer 360 in the field emission cathode structure 300, and the second conductive layer 464 is configured for releasing the possible charges formed in the fixed layer 470. The fixed layer 470 and conductive layer 460 are configured to be located at two flanks of the field emission unit 430 to prevent them from blocking the electrons emitted from the field emission unit 430. The fixed layer 470 and conductive layer 460 should not completely cover the cavity 442.

Figure 5:
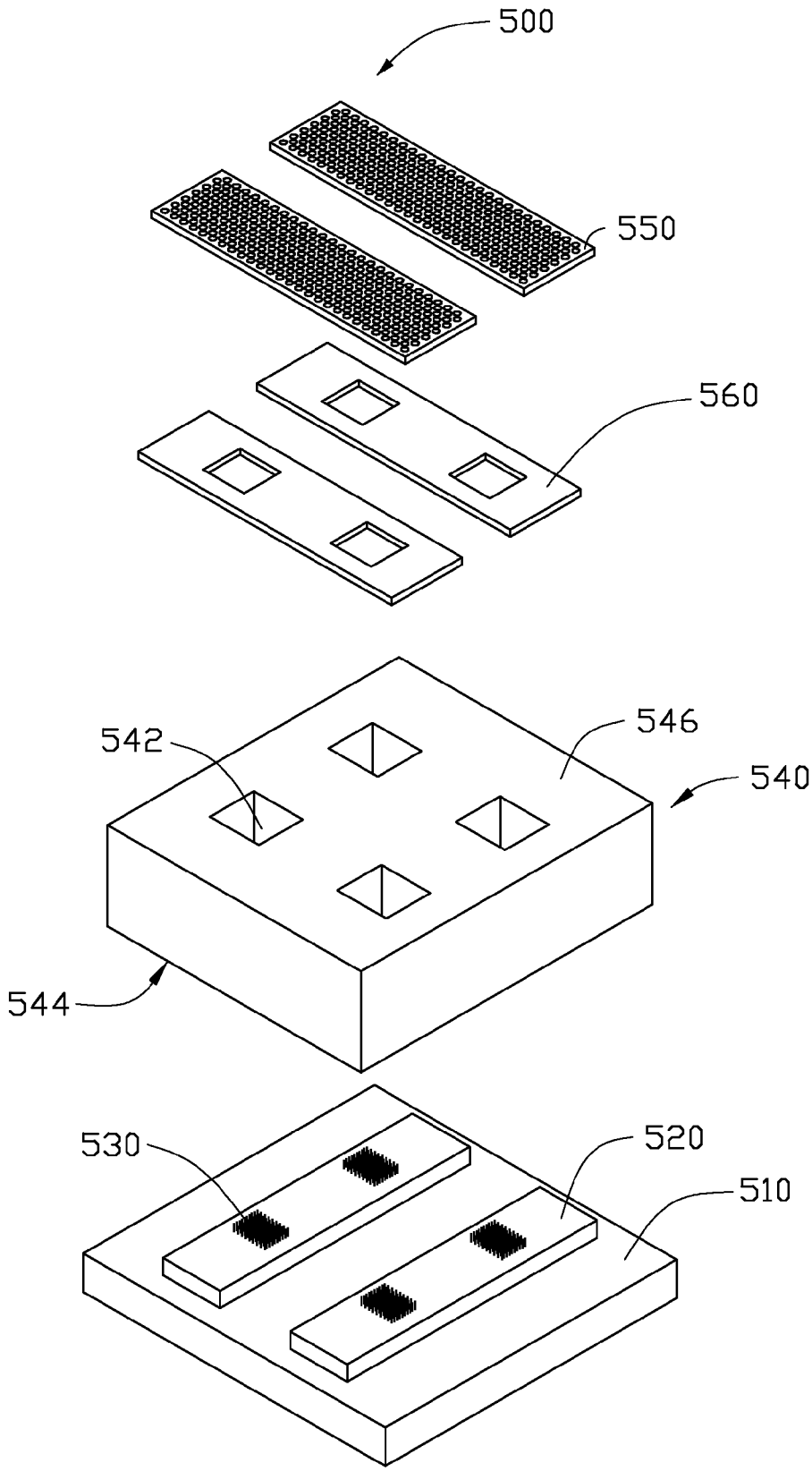
FIG. 5 is an exploded, isometric view of one embodiment of a filed emission cathode structure.
Figure 6:
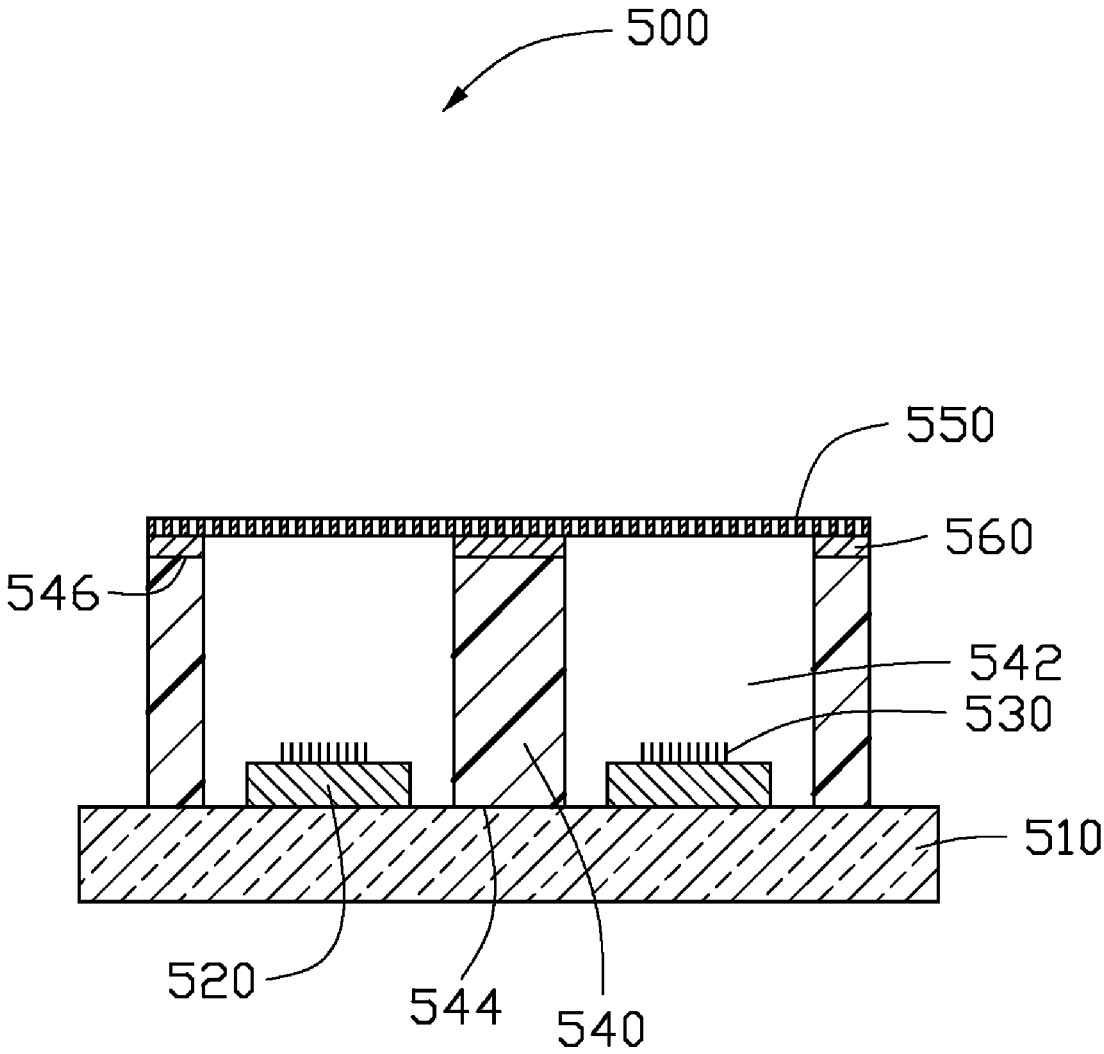
FIG. 6 is a cross-sectional view of a filed emission cathode structure in FIG. 5 once assembled.

Referring to FIGS. 5 and 6, a field emission cathode structure 500 of one embodiment is provided. The field emission cathode structure 500 includes an insulating substrate 510, a plurality of cathode electrodes 520, a plurality of field emission units 530, a dielectric layer 540, a plurality of grid electrodes 550, and a plurality of conductive layer 560. The field emission cathode structure 500 is similar to the field emission cathode structure 100. The difference between two embodiments is the number of cathode electrode, field emission units, grid electrode and conductive layer.

The cathode electrodes 520 are spaced from and are parallel to each other and located on the substrate 510. The number of the cathode electrodes 520 can be determined as desired.

The dielectric layer 540 has a bottom surface 544, a top surface 546, and defines a plurality of cavities 542. The dielectric layer 540 is located on the insulating substrate 510, and the bottom surface 544 is in contact with the insulating substrate 510.

The plurality of field emission units 530 is spaced from each other, and electrically arranged on the cathode electrodes 520. Each field emission unit 530 is positioned in a corresponding cavity 542. The number of the field emission unit 530 can be determined as desired.

The grid electrodes 550 are rectangle or strip. Each grid electrode 550 is a net with a plurality of holes. The grid electrodes 550 are separately parallel to each other. A plane including the grid electrodes 550 is substantially parallel to a plane having the cathode electrodes 520. In one embodiment, a length extending direction of the grid electrodes 550 is substantially perpendicular to a length extending direction of the cathode electrodes 520. The grid electrodes 550 are located on the dielectric layer 540. Electrons emitted from the field emission units 530 emit through the holes of the grid electrodes 550 and focused on the predetermined positions.

The conductive layers 560 are insulated from each other. The conductive layers 560 are perpendicular to the cathodes electrodes 520, and directly located on the top surface 546 of the dielectric layer 540. The conductive layers 560 are insulated from the field emission units 530 and are electrically connected to the grid electrodes 550. The number of the field emission cathode structure 500 can be determined as desired.

In operation, different voltages are applied to the cathode electrode 520 and the grid electrode 550. Electrons emitted from the field emission unit 530 mostly pass through the holes of the grid electrodes 550, and move toward predetermined positions. The cathode electrodes 520 insulate with each other, and the grid electrodes 550 insulate with each other, too; thus, the field emission currents at different field emission units 530 can easily be modulated by selectively changing the voltages of the cathode electrodes 520 and the grid electrodes 550. It is understood that the number of cathode electrodes 520 and grid electrodes 550 can be set as desired to achieve the proper modulation.

It can be understood that the field emission cathode structure 500 also can include a plurality of the field emission cathode structures 100 (shown in FIG. 1). The plurality of field emission cathode structures 100 is electrically insulated with each other.

Figure 7:
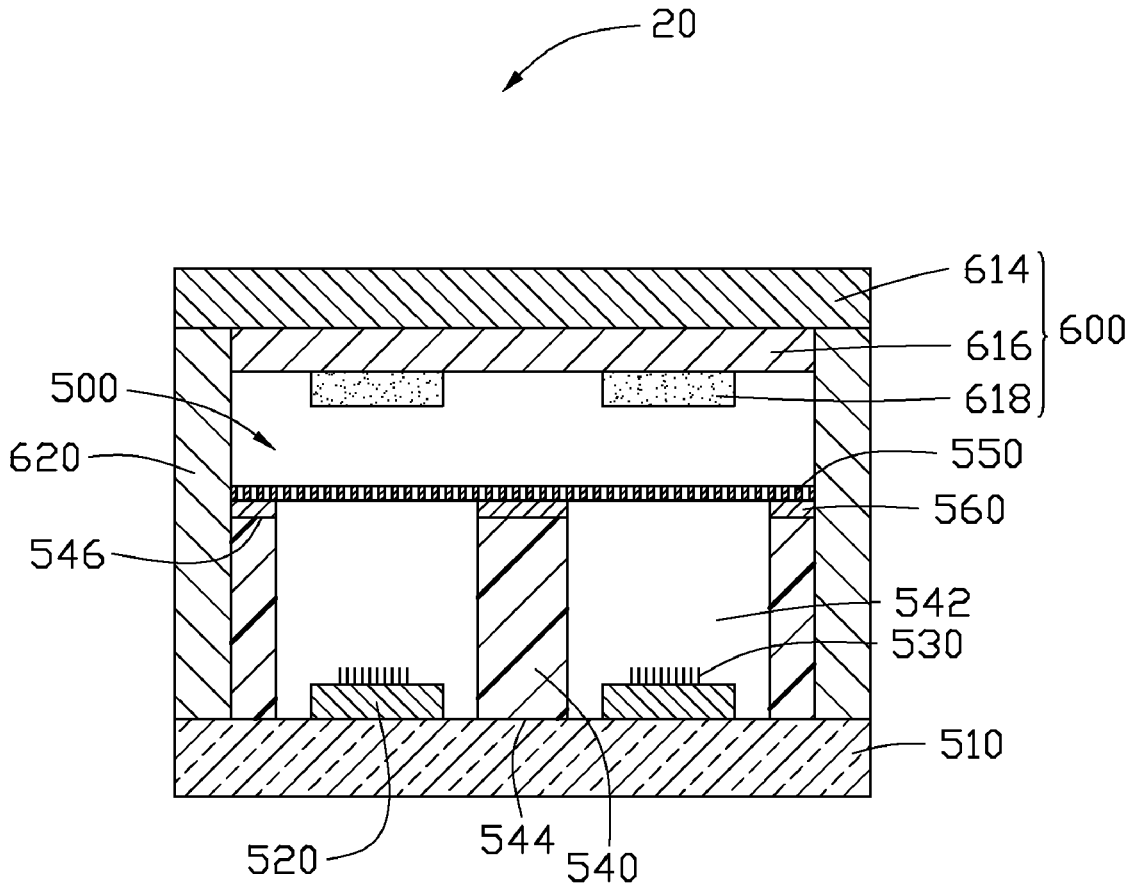
FIG. 7 is a cross-sectional view of a filed emission display using the field emission cathode structure in FIG. 6.

Referring FIG. 7, a field emission display 20 using the field emission cathode structure 500 is provided according to one embodiment. The field emission display 20 includes an anode structure 600 spacing from the field emission cathode structure 500.

The anode structure 600 is spaced from the grid electrodes 550 in the field emission cathode structure 500, and includes a glass substrate 614, a transparent anode 616, and a phosphor layer 618. The transparent anode 616 is mounted on the glass substrate 614. The phosphor layer 618 is coated on the transparent anode 616. An insulated spacer 620 is located between the anode structure 600 and the insulating substrate 510 to maintain a vacuum seal. The edges of the grid electrodes 550 are fixed to the spacer 620. The transparent anode 616 can be ITO film.

In operation of the field emission display 20, different voltages are applied to the cathode electrodes 520 and the grid electrodes 550. Generally, the cathode electrodes 520 are grounded. The voltage of the grid electrodes 550 can range from about ten to several hundred volts. Electrons emitted from the field emission units 530 move towards the grid electrodes 550, and emit through the holes of the grid electrodes 550, under the influence of the applied electric field induced by the grid electrodes 550. Finally, the electrons reach the anode 616 and collide with the phosphor layer 618, under the electric field induced by the anode 616 and the grid electrodes 550. The phosphor layer 618 then emits visible light to accomplish display function of the field emission display 20.

The cathode electrodes 520 insulate with each other, and the grid electrodes 550 insulate with each other, too. Thus, electrons emitted from different field emission units 530 can easily be modulated by selectively changing the voltages of the cathode electrodes 520 and the grid electrodes 550, and then collide with the different phosphor layer 618 to luminescence. Such that, the field emission display 20 can display different images as desired. Electrons emitted from the field emission cathode structure 500 mostly can focus on the phosphor layer 618; thus, the field emission display 20 can display images clearly.

Figure 8:
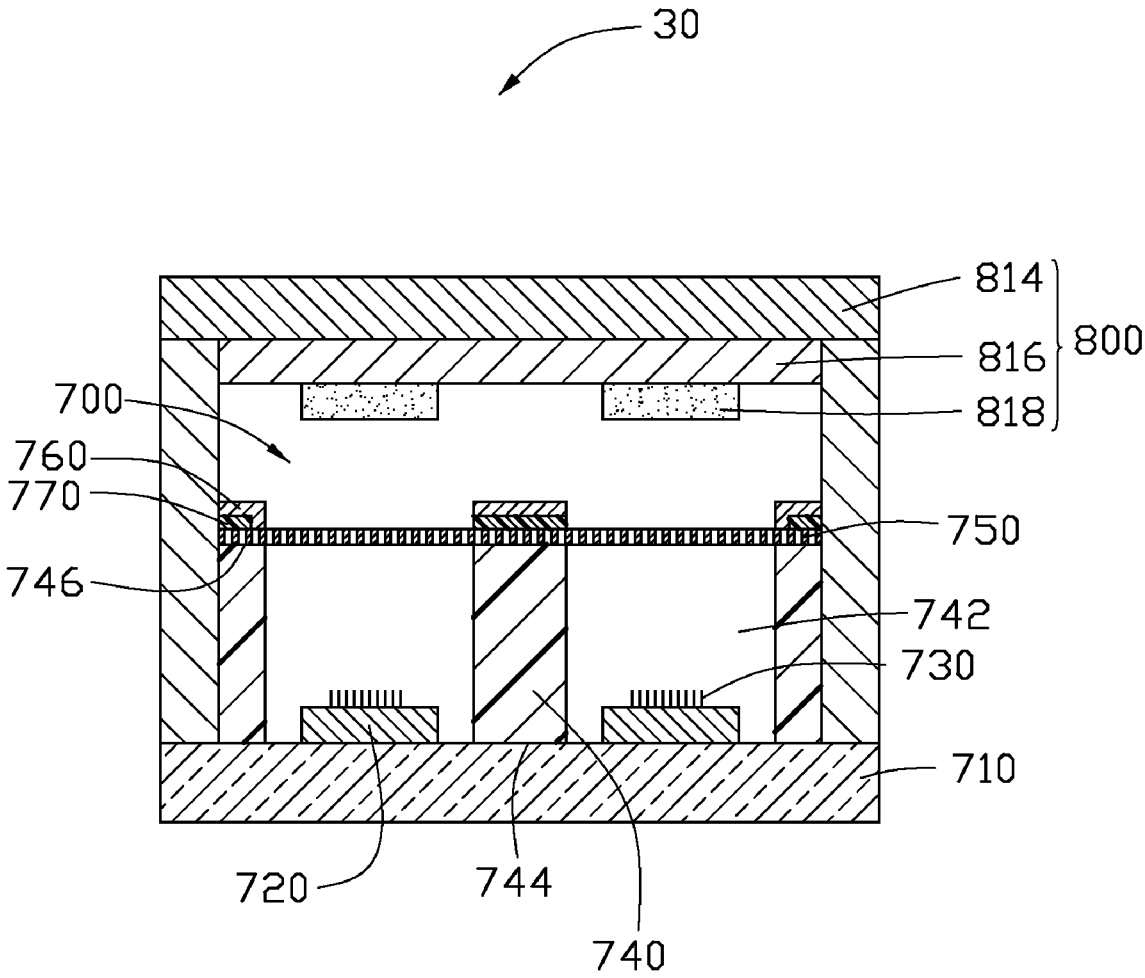
FIG. 8 is a cross-sectional view of another filed emission display using the field emission cathode structure in FIG. 3, wherein a conductive layer is provided.

Referring to FIG. 8, a field emission display 30 is provided according to another embodiment. The field emission display 30 includes a field emission cathode structure 700, and an anode structure 800 spaced from the field emission cathode structure 700.

The field emission cathode structure 700 includes an insulating substrate 710, a plurality of cathode electrodes 720, a plurality of field emission units 730, a dielectric layer 740, a plurality of grid electrodes 750, a plurality of conductive layers 760, and a plurality of fixed layers 770. The dielectric layer 740 includes a plurality of cavities 742, a bottom surface 744, and a top surface. The field emission cathode structure 700 is similar to the field emission cathode structure 300. The difference between two embodiments is the number of cathode electrodes, field emission units, grid electrode and conductive layer. In this embodiment, there is a plurality of the elements. This can be understood that the field emission cathode structure 700 includes a plurality of the field emission cathode structures 300 (shown in FIG. 3). The plurality of field emission cathode structures 300 are electrically insulated from each other.

The field emission display 30 is similar to the field emission display 20, and the field emission cathode structure 700 is different from the field emission cathode structure 500. Specially, the field emission cathode structure 700 further includes the fixed layer 770. The fixed layer 770 is directly located on the grid electrodes 750. The conductive layers 760 are located on the fixed layer 770. The material and structure of the fixed layer 770 can be the same as that of the dielectric layer 740. The fixed layer 770 should not block all of the electrons emitted from the field emission unit 730, thus the fixed layer 770 defines a plurality of second cavities. Each second cavity is associated with a cavity 742. The grid electrodes 750 are directly located on the top surface 746 of the dielectric layer 740 away from the insulating substrate 710.

Figure 9:
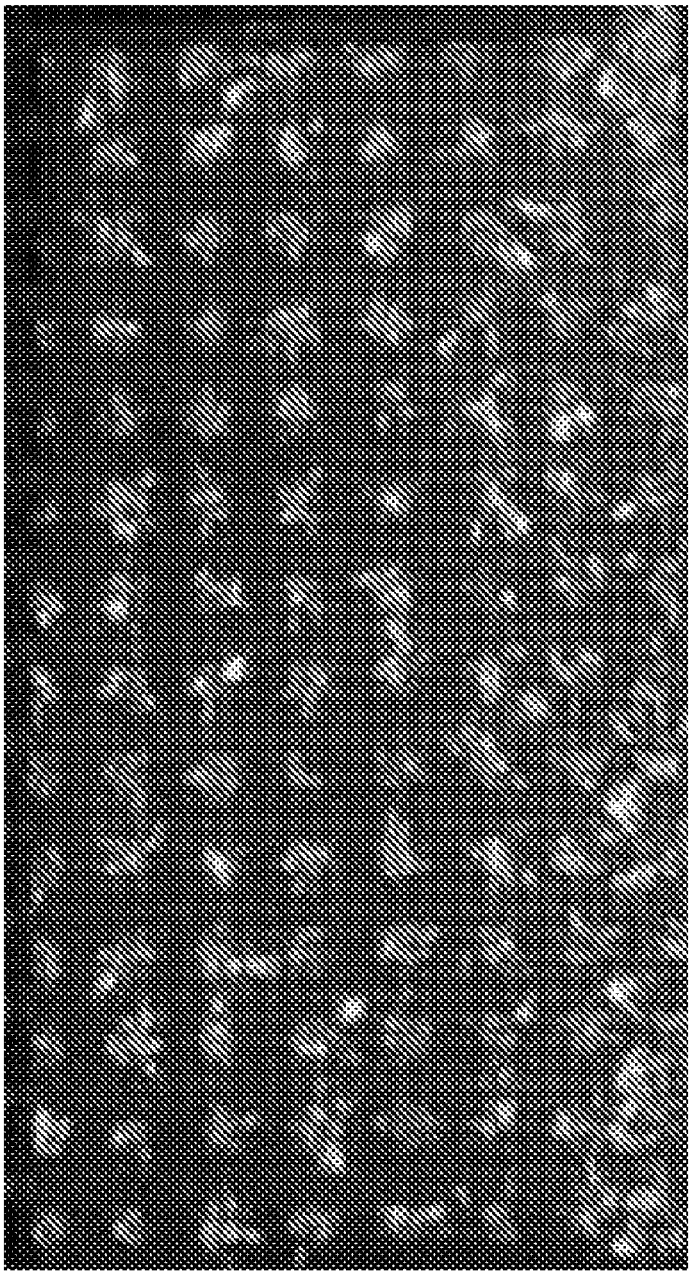
FIG. 9 is a display impression schematic view of a filed emission display similar to the one in FIG. 8 without the conductive layer.
Figure 10:
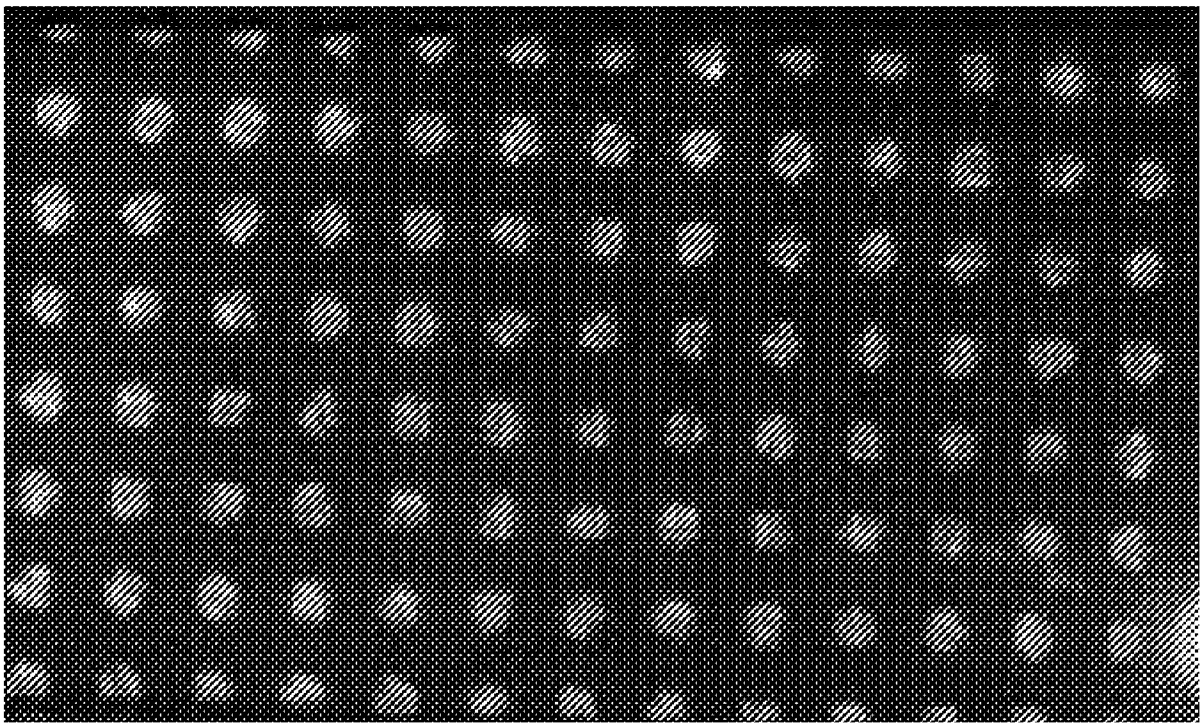
FIG. 10 is a display impression schematic view of a filed emission display similar to the one in FIG. 8.
Figure 11:
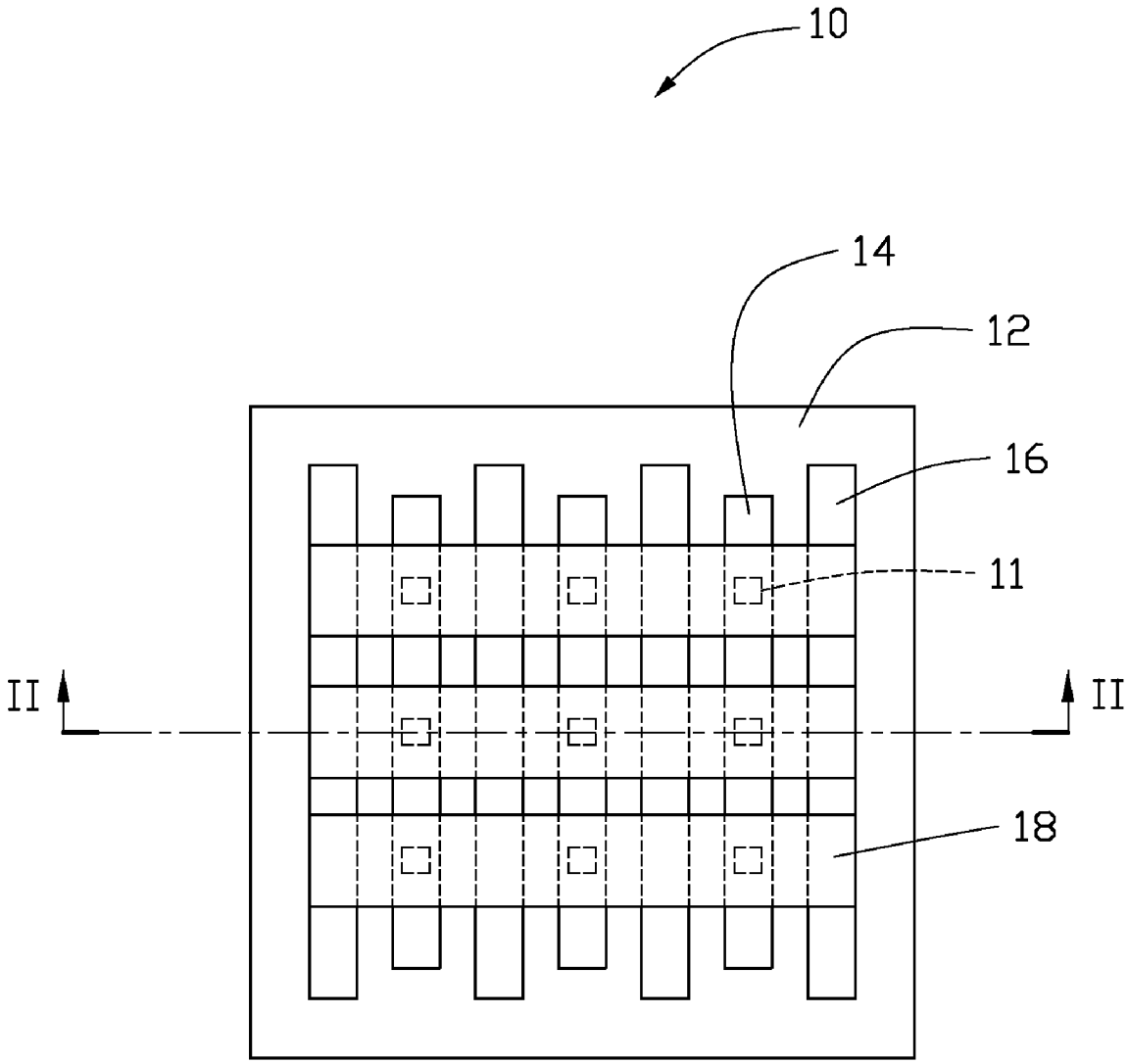
FIG. 11 (PRIOR ART)
FIG. 11 is a top view of a conventional field emission cathode structure, according to the prior art.
Figure 12:
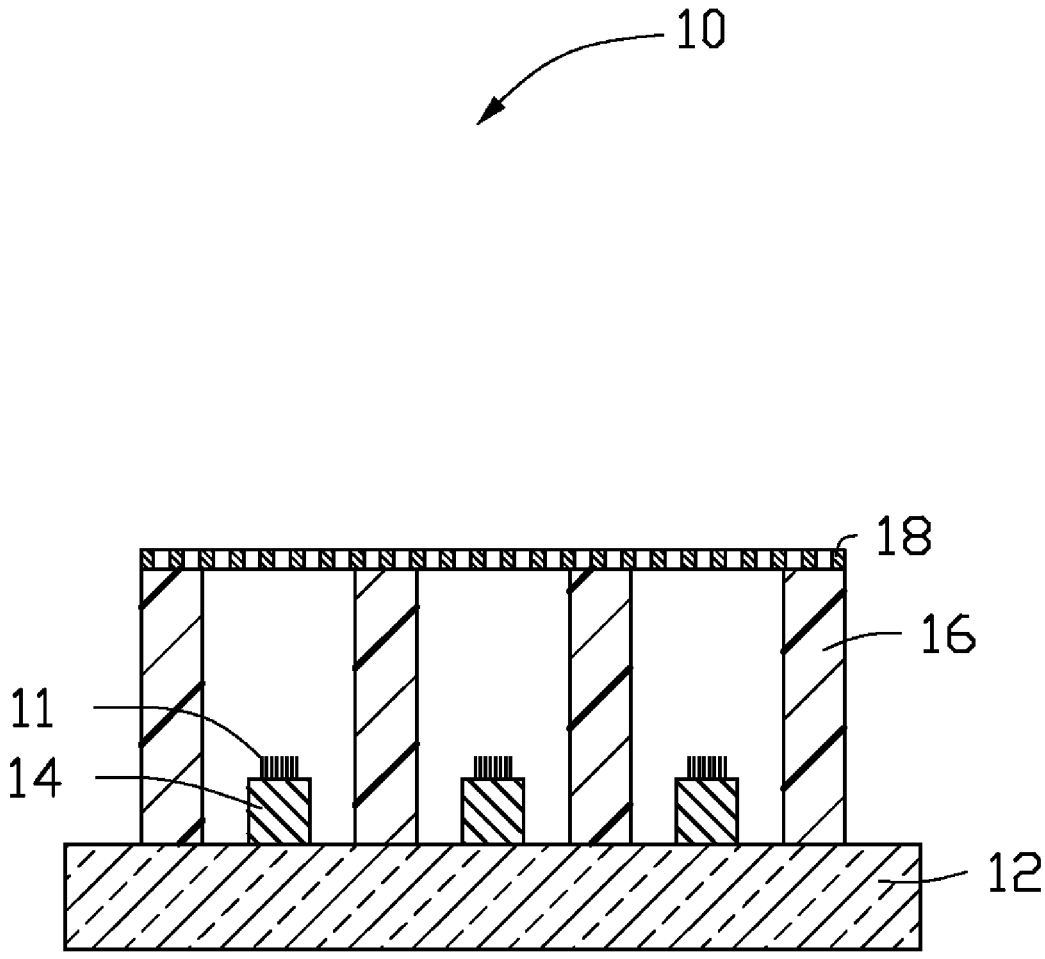
FIG. 12 (PRIOR ART)
FIG. 12 is a cross-sectional view taken along line II-II of FIG. 11.

Referring to FIGS. 9 and 10, FIG. 9 is produced by a filed emission display similar to the filed emission display 30 without the conductive layer 760. FIG. 10 is produced by the filed emission display 30 with the conductive layer 760. The image displayed in FIG. 9 can be fuzzier than that in the FIG. 10. When the field emission display 30 lacks the conductive layer 760, part of electrons emitted from the field emission unit 730 tend to hit the fixed layer 770 and the dielectric layer 740. The fixed layer 770 and dielectric layer 740 may emit secondary electrons to form positive charges thereon. The potential around the fixed layer 770 and the dielectric layer 740 is changed. Thus, the electrons are not as focused, and the image, as shown in FIG. 9, is fuzzy. However, when the field emission display 30 includes the conductive layers 760 electrically connected to the grid electrodes 750, the electrons hitting the conductive layers 760 after emitted through the grid electrodes 750, can be released to the grid electrodes 750. The fixed layer 770 and dielectric layer 740 emit few secondary electrons. Even if some positive charges are formed on the fixed layer 770 and dielectric layer 740, the positive charges mostly are released to the grid electrodes 750 via the conductive layers 760. The potential around the fixed layer 770 and dielectric layer 740 is changed little, if at all. The possibility of electrons errant electrons is reduced, and most of the electrons are focus on their predetermined positions. Thus the field emission display 30 display is clear, just like FIG. 10.

It can be understood that the field emission cathode structures 20, 30, 40 also can be used in field emission displays.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

What is claimed is:

1. A field emission cathode structure comprising:
- an insulating substrate;
- a cathode electrode located on the insulating substrate;
- a dielectric layer attached to the insulating substrate, the dielectric layer defining a cavity;
- a field emission unit electrically connected to the cathode electrode and received in the cavity of the dielectric layer;
- a grid electrode located on the dielectric layer, the grid electrode capable of having electrons emitted from the field emission unit and passing therethrough;
- an upper conductive layer electrically connected to the grid electrode and insulated from the field emission unit, and the grid electrode is located between the upper conductive layer and the dielectric layer; and
- a fixed layer located between the grid electrode and the upper conductive layer.

2. The field emission cathode structure of claim 1, wherein the fixed layer comprises of a material that is selected from the group consisting of glass, silicon dioxide, and ceramic.

3. The field emission cathode structure of claim 1, wherein a material of the upper conductive layer comprises of a material that is selected from the group consisting of metal, alloys, indium tin oxide, antimony tin oxide, silver conductive adhesive, conducting polymers, and carbon nanotubes.

4. The field emission cathode structure of claim 1, further comprising a lower conductive layer located between the grid electrode and the dielectric layer.

5. A field emission display device comprising: an anode structure and a plurality of field emission cathode structures spaced from the anode structure, the plurality of field emission cathode structures are electrically insulated from each other, and each of the field emission cathode structures comprises:
- an insulating substrate;
- a cathode electrode located on the insulating substrate;
- a dielectric layer attached to the insulating substrate, the dielectric layer defining a cavity;
- a field emission unit electrically connected to the cathode electrode and received in the cavity of the dielectric layer;
- a grid electrode located on the dielectric layer, the grid electrode capable of allowing electrons emitted from the field emission unit to pass through the grid electrode; and an upper conductive layer electrically connected to the grid electrode and insulated from the field emission unit;

wherein the upper conductive layer and the grid electrode are two separate layers.

6. The field emission display device of claim 5, wherein the upper conductive layer is located between the grid electrode and the dielectric layer.

7. The field emission display device of claim 5, wherein the grid electrode is located between the upper conductive layer and the dielectric layer.

8. The field emission display device of claim 7, wherein the field emission cathode structure further comprises a fixed layer, and the fixed layer is located between the upper conductive layer and the grid electrode.

9. The field emission cathode structure of claim 8, wherein the fixed layer comprises a material that is selected from the group consisting of glass, silicon dioxide, and ceramic.

10. The field emission display device of claim 7, wherein each of the field emission cathode structures further comprises a lower conductive layer located on a top surface of the dielectric layer, and the grid electrode is located between the lower conductive layer and the upper conductive layer.

11. The field emission cathode structure of claim 10, wherein each of the field emission cathode structure further comprises a fixed layer, and the fixed layer is located between the upper conductive layer and the grid electrode.

12. The field emission cathode structure of claim 5, wherein the conductive layer comprises of a material that is selected from the group consisting of metal, alloys, indium tin oxide, antimony tin oxide, silver conductive adhesive, conducting polymers, and carbon nanotubes.

13. The field emission cathode structure of claim 5, wherein the grid electrode is a stainless steel net.

14. The field emission display device of claim 5, wherein the anode structure comprises a glass substrate, a transparent anode located on the glass substrate, and a phosphor layer located on the transparent anode.

15. The field emission display of claim 5, further comprising an insulated spacer located between the anode electrode structure and the substrate to establish a vacuum seal.

16. A field emission display device comprising: an anode structure and a field emission cathode structure spaced from the anode structure, the field emission cathode structure comprising:

an insulating substrate;

a plurality of cathode electrodes insulated from each other and attached to the insulating substrate;

a dielectric layer attached to the insulating substrate, and the dielectric layer defines a plurality of cavities;

a plurality of field emission units attached on the plurality of cathode electrodes, each filed emission unit electrically connected to a corresponding cathode electrode and received in a corresponding cavity of the dielectric layer, and the plurality of field emission units are insulated from each other;

a plurality of grid electrodes insulated from each other and electrically connected to the dielectric layer, and the grid electrodes capable of having electrons emitted from the field emission units and passing therethrough;

a plurality of upper conductive layers insulated from each other and each upper conductive layer electrically connected to the grid electrode corresponding the upper conductive layer, and the plurality of grid electrodes located between the plurality of upper conductive layers and the plurality of grid electrodes; and a fixed layer located between the plurality of grid electrodes and the plurality of upper conductive layers.

17. The field emission cathode structure of claim 16, wherein the upper conductive layer comprises a material that is selected from the group consisting of metal, alloys, indium tin oxide, antimony tin oxide, silver conductive adhesive, conducting polymers, and carbon nanotubes.

18. The field emission cathode structure of claim 16, wherein the fixed layer defines a plurality of through, and each through hole is associated with one of the cavities.

19. The field emission cathode structure of claim 16, further comprising a plurality of lower conductive layers located between the plurality of grid electrodes and the dielectric layer.

20. The field emission cathode structure of claim 19, wherein the plurality of upper and lower conductive layers comprise materials that are selected from the group consisting of metal, alloys, indium tin oxide, antimony tin oxide, silver conductive adhesive, conducting polymer, and carbon nanotubes.

* * * * *